US008230910B2

(12) United States Patent
Bielesch et al.

(10) Patent No.: US 8,230,910 B2
(45) Date of Patent: Jul. 31, 2012

(54) APPARATUS FOR CONVEYING A COOLING AIR FLOW HAVING A COOLING DOMES

(75) Inventors: Thomas Bielesch, Mühlacker (DE); Benjamin Schweizer, Pforzheim (DE); Michael Spieth, Gomaringen (DE); Ulrich Vollert, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 1041 days.

(21) Appl. No.: 12/090,567

(22) PCT Filed: Oct. 4, 2006

(86) PCT No.: PCT/EP2006/009582

§ 371 (c)(1),
(2), (4) Date: Jun. 20, 2008

(87) PCT Pub. No.: WO2007/045355

PCT Pub. Date: Apr. 26, 2007

(65) Prior Publication Data

US 2008/0264600 A1 Oct. 30, 2008

(30) Foreign Application Priority Data

Oct. 20, 2005 (DE) ..... 10 2005 050 685

(51) Int. Cl.

| | |
|---|---|
| ***F28F 27/00*** | (2006.01) |
| ***F28F 7/00*** | (2006.01) |
| ***B60H 1/00*** | (2006.01) |
| ***F24H 3/06*** | (2006.01) |

(52) U.S. Cl. ..... 165/200; 165/202; 165/80.3; 165/121; 165/122; 165/185; 338/51; 361/697

(58) Field of Classification Search ..... 165/200, 165/201, 202, 41, 42, 121, 122, 185, 80.2, 165/80.3, 104.31, 104.33, 120; 338/50, 51, 338/96; 180/68.1; 123/41.12; 361/697
See application file for complete search history.

(56) References Cited

U.S. PATENT DOCUMENTS

| | | | | |
|---|---|---|---|---|
| 2,541,852 | A * | 2/1951 | Zimmer | 338/51 |
| 4,709,560 | A | 12/1987 | Voorhis et al. | |
| 4,897,712 | A | 1/1990 | Prokopp | |
| 4,935,717 | A * | 6/1990 | Osawa et al. | 338/51 |
| 5,216,983 | A * | 6/1993 | Nilson | 123/41.12 |
| 5,481,433 | A * | 1/1996 | Carter | 165/185 |

(Continued)

FOREIGN PATENT DOCUMENTS

DE 35 23 223 A1 1/1987

(Continued)

*Primary Examiner* — Ljiljana Ciric
(74) *Attorney, Agent, or Firm* — Foley & Lardner LLP

(57) ABSTRACT

An apparatus for conveying a cooling air flow for at least one motor vehicle heat exchanger has a fan frame, a fan wheel, a fan control unit, and a cooling body. The fan frame has a frame opening, which the fan wheel rotates within. The fan control unit is arranged in an edge region of the frame opening. The cooling body cools the fan control unit and has cooling domes. A first cooling dome is arranged entirely radially exterior to the frame opening and a second cooling dome is located partially radially within the frame opening and partially radially exterior to the frame opening. The first cooling dome exchanges heat with an auxiliary flow that flows radially exterior to the frame opening with respect to the center of the fan wheel when the fan wheel rotates.

13 Claims, 6 Drawing Sheets

U.S. PATENT DOCUMENTS

| | | | | | |
|---|---|---|---|---|---|
| 5,563,570 | A | * | 10/1996 | Lee | 338/50 |
| 5,859,581 | A | * | 1/1999 | Morris | 338/50 |
| 5,947,189 | A | | 9/1999 | Takeuchi et al. | |
| 6,199,398 | B1 | * | 3/2001 | Takeuchi et al. | 62/133 |
| 6,364,004 | B1 | | 4/2002 | Ehrmann et al. | |
| D464,327 | S | * | 10/2002 | Frank, Jr. | D13/162 |
| 6,840,743 | B2 | * | 1/2005 | Herke et al. | 417/2 |
| 6,883,589 | B2 | * | 4/2005 | Ozawa et al. | 165/122 |
| 7,992,664 | B2 | * | 8/2011 | Kiener et al. | 180/68.1 |
| 8,096,136 | B2 | * | 1/2012 | Zheng et al. | 165/80.3 |
| 2008/0205001 | A1 | * | 8/2008 | Saito et al. | 361/697 |
| 2010/0154468 | A1 | * | 6/2010 | Shaska et al. | 165/104.31 |

FOREIGN PATENT DOCUMENTS

| | | | | |
|---|---|---|---|---|
| DE | 44 41 039 | C1 | * | 5/1996 |
| DE | 196 12 679 | C2 | | 10/1997 |
| DE | 199 49 322 | C1 | | 1/2001 |
| DE | 199 49 321 | C1 | | 5/2001 |
| DE | 103 21 732 | A1 | | 12/2004 |
| EP | 0 074 068 | A1 | * | 8/1982 |
| EP | 0 278 240 | A2 | | 8/1988 |
| EP | 0 652 375 | A1 | * | 10/1994 |
| EP | 0 743 501 | A1 | * | 11/1996 |
| FR | 2 764 747 | | * | 6/1997 |
| FR | 2 772 844 | A1 | | 6/1999 |
| FR | 2 827 345 | | * | 7/2007 |
| JP | 9-79188 | | * | 3/1997 |
| JP | 9-156343 | | * | 6/1997 |
| JP | 9-261915 | | * | 10/1997 |
| JP | 2001-163038 | | * | 6/2001 |

* cited by examiner

APPARATUS FOR CONVEYING A COOLING AIR FLOW HAVING A COOLING DOMES

BACKGROUND

Apparatuses for conveying a cooling air flow are known as fans for a coolant radiator or a cooling module and as heating or climate control fans for motor vehicles. The fan or the fan wheel is driven by an electric motor, the drive being regulated by an electronic control device which outputs waste heat. The electronic control device therefore has to be cooled, for which purpose what are known as cooling bodies are used which are connected firstly to the control unit so as to conduct the heat and secondly have cooling fins or pins, what are known as cooling domes, which are loaded by a cooling air flow. A cooling body of this type has been disclosed, for example, by EP 0 278 240 A2 of the applicant.

DE 35 23 223 A1 of the applicant has disclosed a radial fan for a heating and/or climate control system of a motor vehicle, a motor holder being configured as a fan frame, on which power electronics are arranged. The fan frame is configured as a metal part and therefore dissipates the waste heat which is produced in the power electronics or the control unit indirectly to the air flow which is sucked in by the fan.

DE 196 12 679 C2 has disclosed a cooling fan for motor vehicles, that is to say an apparatus for conveying a cooling air flow by means of an axial fan which is driven by electric motor for a coolant radiator of a motor vehicle. The drive has control electronics on a printed circuit board in an electronic housing which is fastened to the fan frame (fan hood). The fan frame is fastened to the radiator and has a frame opening, in which a casing fan rotates. The cooling air flow which is sucked in through the radiator is therefore channeled by the fan frame and conveyed through the frame opening. A cooling body having cooling fins is arranged on the electronic housing, which cooling fins protrude into the cooling air flow, to be precise either upstream or downstream of the fan. In every case, the cooling fins protrude radially into the external diameter of the fan or the fan cover. Disadvantages here are firstly the additional axial installation space and secondly the undesirable noise development, in particular if the cooling fins are arranged on the inflow side of the fan.

SUMMARY

It is an object of the present invention to improve an apparatus for conveying a cooling air flow of the type which is mentioned in the introduction with regard to the cooling of the electronics, in particular with the avoidance of undesirable noise development and additional installation space.

There is provision according to the invention for at least one part of the cooling body to be arranged radially outside the frame opening and to be loaded by an auxiliary flow of the cooling air flow. The cooling body which has elements for heat dissipation, for example in the form of cooling fins or cooling pins, therefore does not protrude into the main cooling air flow; this results in the advantage that unpleasant noise is avoided, since the cooling air flow remains undisrupted.

According to one advantageous refinement of the invention, the fan is configured as a casing fan which is arranged behind the frame opening or the frame inlet in the air flow direction. Here, a gap is left in the axial direction between the frame and the fan cover, as a result of which an auxiliary flow is produced which flows over the cooling fins or cooling pins of the cooling body and therefore achieves a cooling effect. The direction of the auxiliary flow depends on the operating state of the fan or on the pressure gradient in front of and behind the fan. If the fan sucks in air from the region of the fan frame, it also sucks in the auxiliary flow via the gap which produces a vertical eddy in the form of a recirculation flow. If the fan is overblown, with the result that a higher pressure is produced in front of the fan than behind the fan, the direction of the auxiliary flow will be reversed, by a leakage flow being set through the gap via the cooling fins. A cooling effect is also achieved in this case.

According to a further advantageous refinement of the invention, the frame opening is delimited by a cylindrical frame ring, in which the casing fan circulates, while a bypass channel (having the cooling body or heat dissipating elements) is arranged radially outside the frame ring. This bypass channel likewise results in a cooling auxiliary flow which, depending on the operating point of the fan or the pressure gradient which is present, changes its flow direction. If the fan is overblown on account of the high speed of the vehicle and a high back pressure, the bypass channel acts as a real bypass, through which an auxiliary flow flows in the same direction as the main cooling air flow. In contrast, during suction operation of the fan, a recirculation flow will be produced, that is to say the fan sucks in cooling air which has already been conveyed via the bypass channel.

According to a further advantageous refinement of the invention, a part of the cooling body is arranged radially within the frame ring or the fan cover, that is to say a region of the cooling fins or cooling pins protrudes into the main cooling air flow, to be precise on the outflow side of the fan. Therefore, one part of the heat dissipating elements lies radially outside the frame opening or the cover diameter and a further part which lies downstream lies radially outside and inside the frame opening or the cover diameter. The advantage of an increased cooling effect is achieved in this way.

According to a further advantageous refinement of the invention, the cooling fins or what are known as cooling domes protrude from the base plate of the cooling body to different heights. The cooling body or its base plate which is of flat configuration extends both in the axial direction and in the circumferential direction. In order to utilize the flow cross section between the base plate and the frame ring or fan cover as effectively as possible, the height of the cooling fins or cooling pins is adapted to the diameter of the frame ring or the fan cover, with the result that an approximately identical spacing between cooling fins and the frame circumference is achieved on the circumference. The advantage of an improved cooling action is also achieved in this way.

BRIEF DESCRIPTION OF THE DRAWINGS

Exemplary embodiments of the invention are shown in the drawing and will be explained in greater detail in the following text. In the drawing.

DETAILED DESCRIPTION

Figure 1:
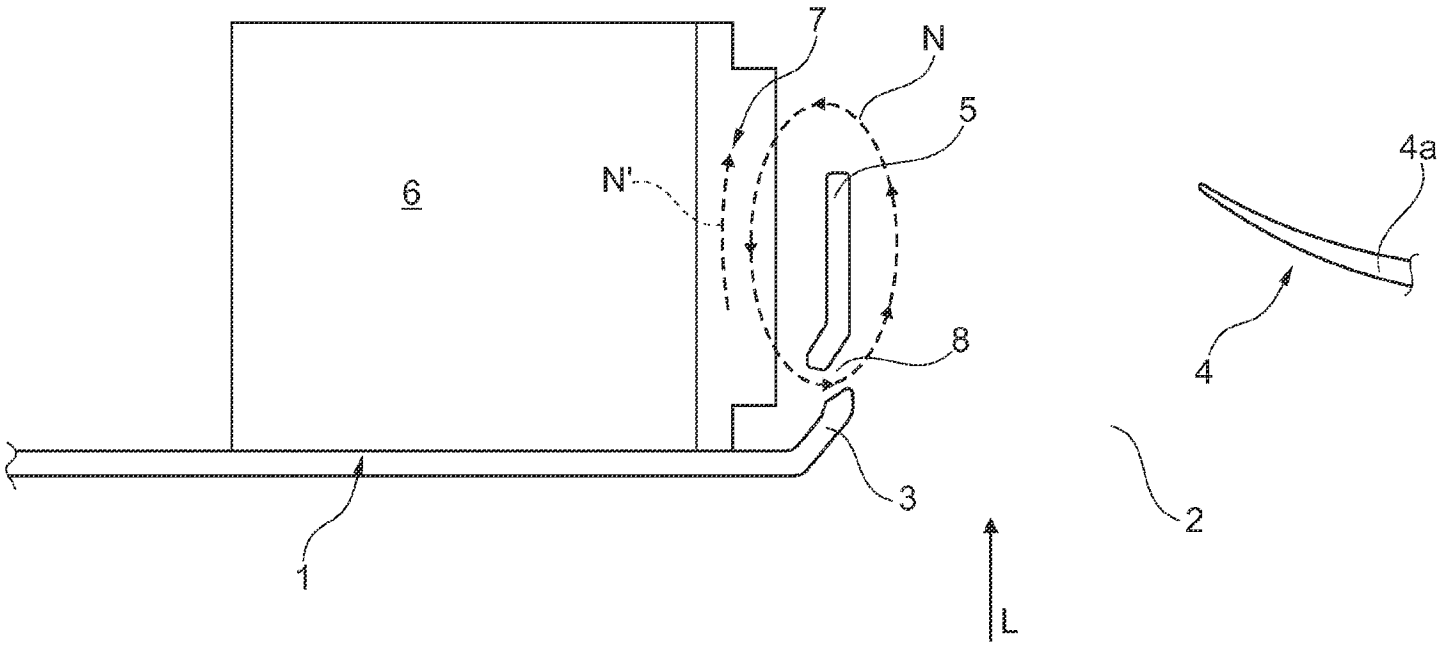
FIG. 1 shows a fan control unit having a cooling body radially outside a fan cover (first exemplary embodiment of the invention)

FIG. 1 shows a partially illustrated fan frame 1 having a frame opening 2 which is delimited by a frame inlet 3. A casing fan 4 which is shown only partially is arranged within the frame opening 2, which casing fan 4 has fan blades 4*a* which are likewise shown only partially and a cover 5 which connects the tips of the fan blades 4*a*. In its entire formation and function, the fan frame 1 corresponds approximately to the fan frame which is disclosed in the prior art mentioned in the introduction for a coolant radiator of a motor vehicle and is therefore arranged downstream of a coolant radiator (not shown) or a cooling module of a motor vehicle. The fan 4 can be connected to the frame 1 in a manner which is not shown and is driven by an electric motor (not shown) which is regulated via a control unit 6. Electronic components (not shown), what are known as power electronics, are arranged in the control unit 6, the waste heat of the electronic components being dissipated via a cooling body 7, connected to the control unit 6. The cooling body 7 which has elements (not shown here) for heat dissipation is arranged radially outside the fan cover 5. Within the cover 5, a main cooling air flow is conveyed in the direction of the arrow L and is sucked through the heat exchanger or heat exchangers (not shown). An axial gap 8 which makes a leakage or auxiliary air flow possible is left between the (stationary) frame inlet 3 and the (circulating) fan cover 5. The auxiliary flow is shown with dashed lines and is denoted by M: if the fan 4 is in sucking mode, a recirculation flow is formed in the form of an eddy N, the auxiliary flow being sucked in by the cooling air flow L through the gap 8 via the cooling body 7. The cooling body 7 is therefore cooled by convection. The direction of the auxiliary flow N can then be reversed if the fan 4 is "overblown" at a high vehicle speed, that is to say at a correspondingly high back pressure. The fan 4 does not then supply energy to the air flow anymore and acts as a resistance. In this case, the back pressure will "press" an auxiliary flow through the gap 8, which auxiliary flow runs via the cooling body 7 in the direction of a dotted arrow N'.

Figure 2:
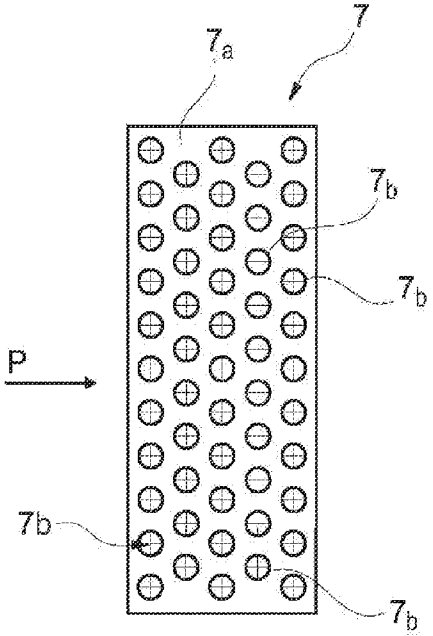
FIGS. 2, 2*a* show a cooling body having a constant pin height.
Figure 2A:
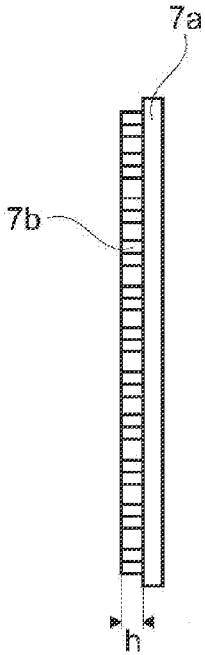

FIG. 2 and FIG. 2*a* show the cooling body 7 in a plan view and a side view. Perpendicularly protruding pins or what are known as cooling domes 7*b* are arranged in rows and offset with respect to one another on a metallic, flat base plate 7*a*. The air flow direction is labeled by an arrow P. The base plate 7*a* is connected to the power electronics of the control unit 6 so as to conduct heat, with the result that the waste heat which is to be dissipated passes by conduction into the cooling dome 7*b*, from where it is dissipated to an air flow via convection.

Figure 3:
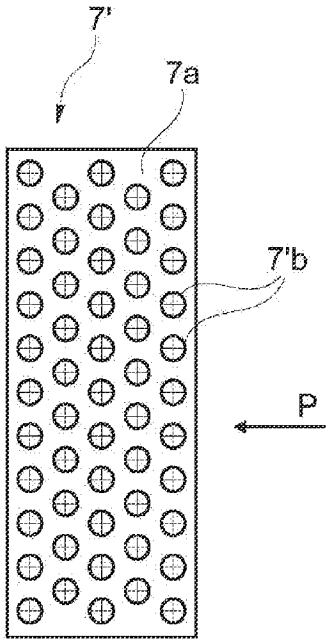
FIGS. 3, 3*a* show a cooling body having a variable pin height.
Figure 3A:
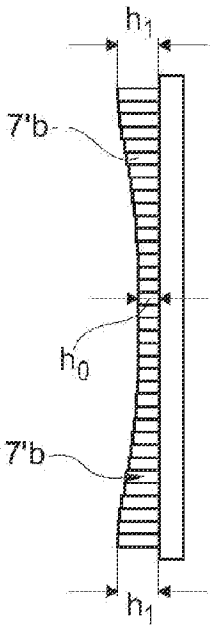

FIG. 3 and FIG. 3*a* show a modified cooling body 7, having a variable height of the cooling domes 7'*b*, which variable height varies between a minimum height h0 approximately in the center and a maximum height h1 in the outer region. The height of the cooling domes 7'*b* is adapted to the circular circumference of the fan cover 5, so that an improved cooling action results.

Figure 4:
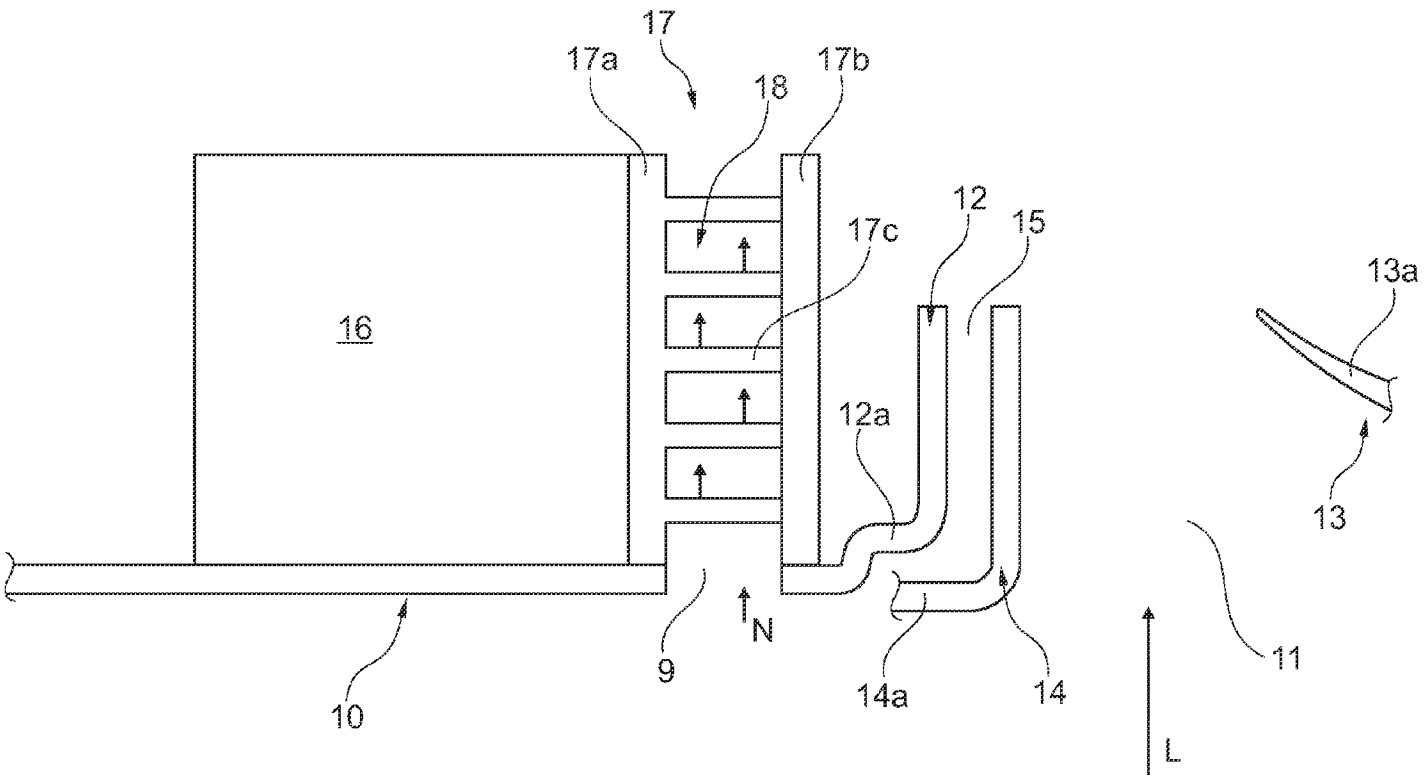
FIG. 4 shows a second exemplary embodiment of the invention having a cooling body which is arranged radially outside a frame ring and a bypass channel for the cooling body.

FIG. 4 shows a further exemplary embodiment of the invention having a fan frame 10 and a circular frame opening 11 which is delimited by a frame ring 12 of hollow-cylindrical configuration. A casing fan 13 having partially indicated fan blades 13*a* and a cover 14 circulates within the frame ring 12. Together with the frame ring 12, the cover 14 forms a radial gap 15. The cover 14 has an end-side inlet region 14*a* and the frame ring 12 has an end-side inlet region 12*a*, which inlet regions overlap in the radial direction. A control unit 16 which is connected to a cooling body 17 so as to conduct heat is arranged radially outside the frame ring 12. The cooling body 17 has two plates 17*a*, 17*b*, through which a bypass channel 18 is formed which is flow-connected to a through opening 19 in the fan frame 10. Heat dissipating elements 17*c* are arranged within the bypass channel 18. In the event of a corresponding pressure gradient, the bypass channel 18 permits a bypass flow, shown by dashed arrows N, parallel to the main cooling air flow, shown by the arrow L. However, this bypass flow will only be produced if a corresponding excess pressure, caused by a corresponding back pressure, prevails within the fan frame 10. Otherwise, that is to say when the fan 13 is in sucking mode, the flow direction in the bypass channel 18 will be reversed, and a recirculation flow will be formed, the fan 13 sucking in cooling air through the bypass channel 18 again, which cooling air has already been conveyed.

Figure 5:
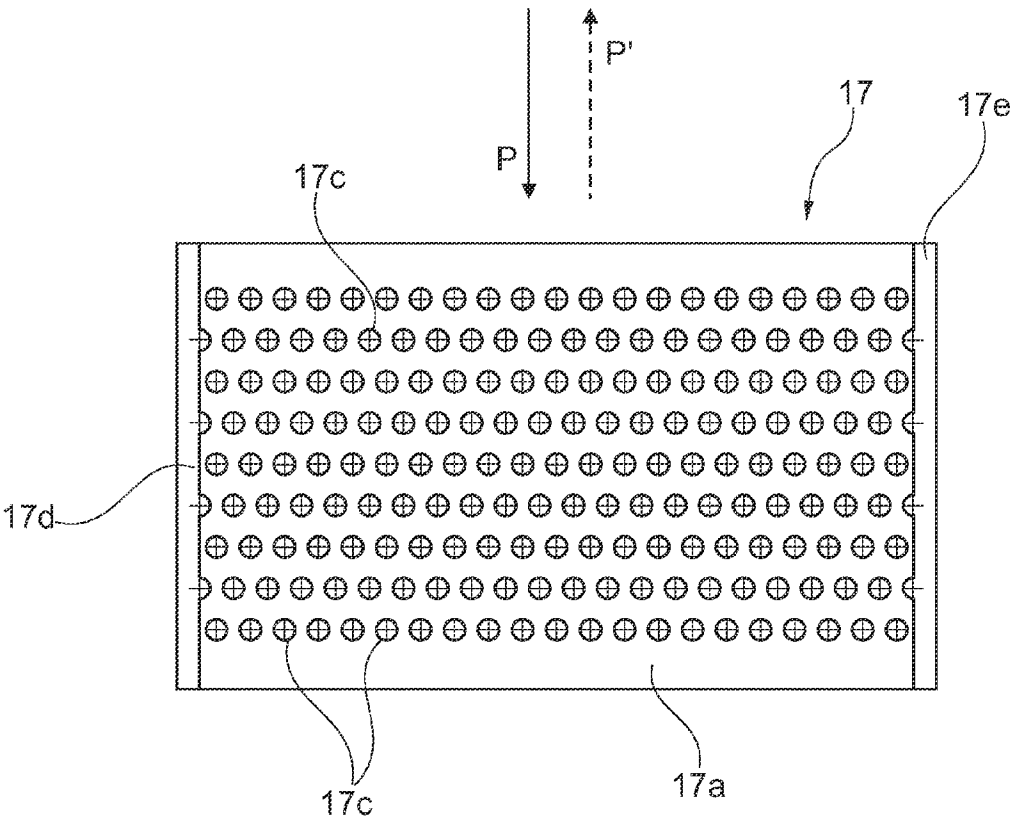
FIG. 5 shows a further exemplary embodiment for a cooling body.

FIG. 5 shows the cooling body 17 for the exemplary embodiment according to FIG. 4 having an air flow direction P or P'. Cooling domes 17*c* which are delimited laterally by channel walls 17*d*, 17*e* are once again arranged on the base plate 17*a*. The cooling domes 17*c* are once again arranged in rows and offset with respect to one another, so that a very satisfactory cooling action by convection results.

Figure 6:
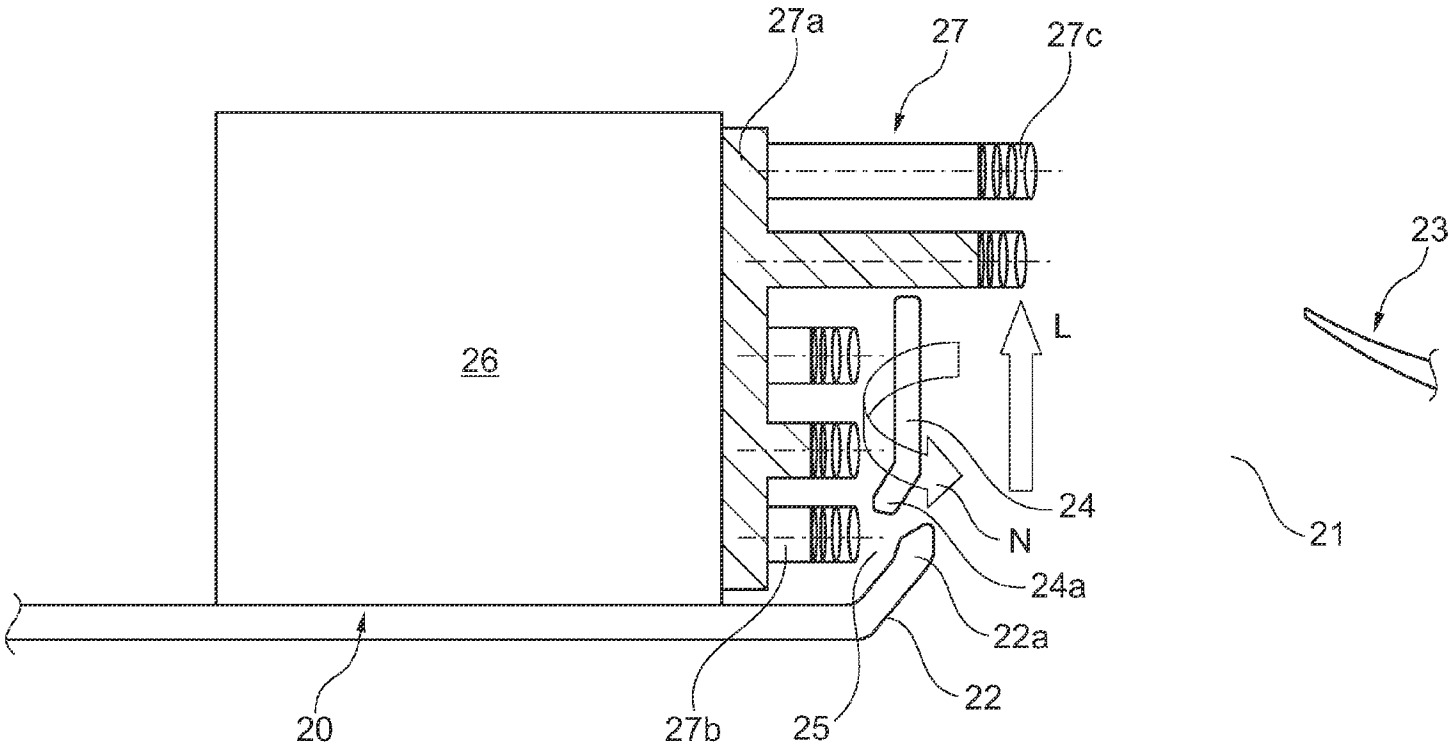
FIG. 6 shows a third exemplary embodiment of the invention having a cooling body, the cooling pins of which are arranged both radially outside the casing fan and within the cover diameter.

FIG. 6 shows a third exemplary embodiment of the invention having a frame 20 which has a frame opening 21 which is delimited by a frame inlet 22 of approximately bell-shaped configuration. A casing fan 23 having a cover 24 is arranged within the frame opening 21, the cover being arranged downstream of the frame inlet 22 as viewed in the air flow direction L. An axial gap 25 which produces a leakage or auxiliary flow is left between a rear edge 22*a* of the frame inlet 20 and a front edge 24*a* of the cover 24. A fan control unit 26 which is connected to a base plate 27*a* of a cooling body 27 so as to conduct heat is arranged on the outer side of the frame 20. Cooling domes 27*b*, 27*c* of different heights are arranged on the base plate 27*a*. The shorter cooling domes 27*b* are arranged radially outside the fan cover 24, while the cooling domes 27*c* which lie downstream (in the direction of the arrows L) have a greater height and extend as far as into the main cooling air flow L, that is to say into the diameter of the fan cover 24. The tips of the cooling domes 27*c* are therefore flowed around and cooled by the main cooling air flow L. In contrast, the shorter cooling domes 27*b* are flowed around by an auxiliary flow, shown by the arrows N, which auxiliary flow is produced as a consequence of the fan rotation and the axial gap 25. The auxiliary flow N is therefore directed substantially counter to the main flow L.

As a result of the combination of cooling domes 27*b*, 27*c* which extend radially outside the fan cover 24 and radially inside the cover diameter, a reinforced cooling effect is achieved, that is to say improved thermal dissipation of the waste power.

Figure 7:
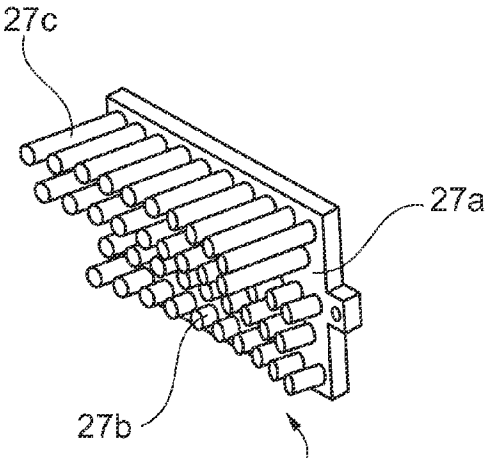
FIG. 7 shows the cooling body for the exemplary embodiment according to FIG. 6 in a 3D illustration.
Figure 8:
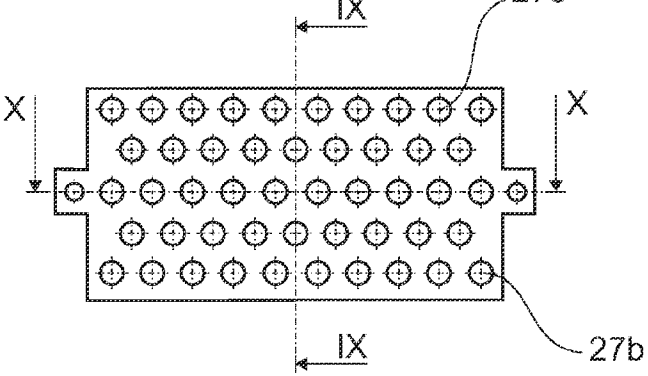
FIG. 8 shows the cooling body in a plan view.
Figure 10:
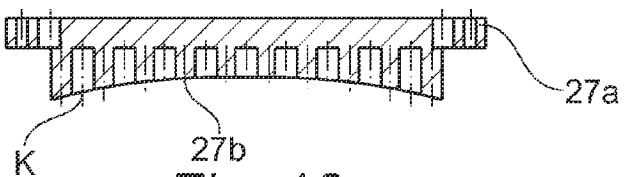
FIG. 10 shows the cooling body in longitudinal section according to the line X-X.
Figure 9:
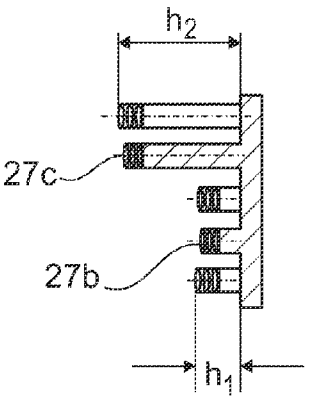
FIG. 9 shows the cooling body in cross section according to the line IX-IX.

FIGS. 7 to 11 show the cooling body 27 for the exemplary embodiment according to FIG. 6. FIG. 7 shows the cooling body 27 in an isometric illustration, it being possible for the different heights of the cooling domes 27*b*, 27*c* to be seen clearly. The height changes both in the axial and in the circumferential direction. FIG. 8 shows a plan view of the cooling body 27 having the offset arrangement of the cooling domes 27*b*, 27*c*. FIG. 9 shows a cross section along the line IX-IX, the different heights h1 for the shorter cooling domes 27*b* and the heights h2 for the longer cooling domes 27*c* being illustrated. FIG. 10, a longitudinal section along the line X-X, shows that the height of the cooling domes 27*b* also varies in the circumferential direction, to be precise along a circular arc K which corresponds to the circular circumference of the fan cover 24 (cf. FIG. 6).

Figure 11:
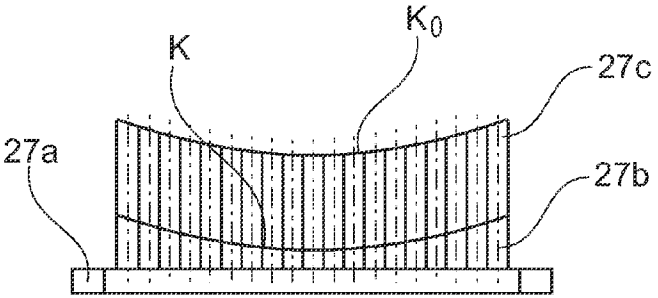
FIG. 11 shows the cooling body in a projection.

FIG. 11 shows the cooling body 27 in a projection, once again it being possible to see the varying height of the cooling domes which is adapted to circular arcs K and K0.

The invention claimed is:

1. An apparatus for conveying a cooling air flow for at least one motor vehicle heat exchanger, comprising:

a fan frame having a frame opening, a fan wheel configured to rotate in the frame opening, a fan control unit which is arranged in an edge region of the frame opening, and a cooling body configured to cool the fan control unit and comprising a plurality of cooling domes, wherein a first cooling dome is arranged entirely radially exterior to the frame opening with respect to a center of the fan wheel, and a second cooling dome is located partially radially within the frame opening and partially radially exterior to the frame opening with respect to the center of the fan wheel, wherein the first cooling dome is configured to exchange heat with an auxiliary flow that flows radially exterior to the frame opening with respect to the center of the fan wheel when the fan wheel rotates.

2. The apparatus as claimed in claim 1, wherein the frame opening has a frame ring of cylindrical configuration.

3. The apparatus as claimed in claim 2, wherein the first cooling dome is arranged radially exterior to the frame ring and forms a bypass channel.

4. The apparatus as claimed in claim 3, wherein the bypass channel has a through opening which is arranged in the fan frame for the auxiliary flow.

5. The apparatus as claimed in claim 4, wherein heat dissipation elements are arranged in the bypass channel.

6. The apparatus as claimed in claim 1, wherein the fan wheel has a cover.

7. The apparatus as claimed in claim 1, wherein the frame opening has an air inlet region having a bell-shaped configuration, and a cover is arranged between the air inlet region and the second cooling dome such that a gap is formed between the air inlet region and a front edge of the cover.

8. The apparatus as claimed in claim 7, wherein the auxiliary flow is generated in a region of the gap and the front edge of the cover by rotation of the fan wheel.

9. The apparatus as claimed in claim 1, wherein the second cooling dome is configured to exchange heat with the cooling air flow when the fan wheel rotates.

10. The apparatus as claimed in claim 9, further comprising a cover located between an air inlet region of the frame opening and the second cooling dome, and wherein the second cooling dome protrudes into the frame opening and is configured to exchange heat with the cooling air flow.

11. The apparatus as claimed in claim 1, wherein a length of the first cooling dome differs from a length of the second cooling dome.

12. The apparatus as claimed in claim 1, further comprising a base plate connected to a first end of each of the plurality of cooling domes.

13. The apparatus as claimed in claim 12, wherein each of the plurality of cooling domes includes a second end, and wherein the second ends form an arc that corresponds to an outer circumference of a fan cover.

* * * * *